US007469814B2

(12) United States Patent
Philips

(10) Patent No.: US 7,469,814 B2
(45) Date of Patent: Dec. 30, 2008

(54) PRE-GLUED DISPLAY BASE AND REINFORCED PEDESTAL

(75) Inventor: Nicholas A. Philips, Sugar Grove, IL (US)

(73) Assignee: International Paper Company, Memphis, TN (US)

( * ) Notice: Subject to any disclaimer, the term of this patent is extended or adjusted under 35 U.S.C. 154(b) by 126 days.

(21) Appl. No.: 11/428,156

(22) Filed: Jun. 30, 2006

(65) Prior Publication Data

US 2008/0000805 A1 Jan. 3, 2008

(51) Int. Cl.
*B65D 25/06* (2006.01)
*B65D 5/486* (2006.01)

(52) U.S. Cl. ..... 229/120.11; 206/736; 206/750; 229/120.18

(58) Field of Classification Search ..... 229/120.11, 229/120.18, 164; 206/736, 750, 764; 40/312
See application file for complete search history.

(56) References Cited

U.S. PATENT DOCUMENTS 1,649,211 A * 11/1927 Bitzer ..... 229/164
2,643,811 A * 6/1953 Bolding ..... 229/120.18
3,347,356 A * 10/1967 Kossnar ..... 206/45.29
4,313,554 A * 2/1982 Montealegre ..... 229/120.18
4,407,442 A * 10/1983 Watson et al. ..... 229/164
5,044,548 A * 9/1991 Olsen et al. ..... 229/120.18
5,088,641 A * 2/1992 Shepard ..... 229/120.18
5,328,089 A * 7/1994 Forbes, Jr. ..... 229/120.18
5,520,324 A * 5/1996 Cai ..... 229/164
5,605,279 A * 2/1997 Adamek ..... 229/906
5,722,584 A * 3/1998 Fujiwara ..... 229/120.18
5,938,109 A * 8/1999 Sainz et al. ..... 229/120.11
6,112,977 A * 9/2000 Sutherland et al. ..... 229/120.18
6,510,943 B2 * 1/2003 Okin et al. ..... 229/120.18

* cited by examiner

*Primary Examiner*—Gary E Elkins

(57) ABSTRACT

The embodiments of the present invention provide a blank foldable material that may be configured to form a display container. When formed, the display container is a single piece display container with sufficient structural integrity to withstand considerable weight stacked thereon. The blank is configured to form a display container that includes a pedestal portion that includes a double thickness central support and a cover portion that provides a stacking surface. The cover portion may be included or it may be substantially horizontal. Also, the display container includes a substantially vertical back portion to provide additional support for items placed upon the stacking surface. The container is easy us manufacture and assemble, yet of relatively high strength.

10 Claims, 4 Drawing Sheets

PRE-GLUED DISPLAY BASE AND REINFORCED PEDESTAL

FIELD OF INVENTION

This invention relates generally to cellulose-based blanks and display containers and more specifically, to wood cellulose-based blanks and containers used for displaying goods in retail or wholesale markets.

BRIEF DESCRIPTIONS OF THE DRAWINGS

Various embodiments of the present invention are described in detail below with reference to the following drawings.

DETAILED DESCRIPTION

The present invention provides a blank and resulting container for holding a variety of goods. By way of overview with reference to FIGS. 1 through 6, an embodiment of the present invention includes a single piece blank 20 of foldable material arranged to form a display container 50.

The blank 20 is preferably constructed from a single piece of formable material such as, without limitation, sheets of cellulose-based material formed from cellulose materials such as wood pulp, straw, cotton, bagasse, or the like. Cellulose-based materials used in the present invention come in many forms such as fiberboard, containerboard, corrugated containerboard and paperboard. The blank 20 is cut, scored, perforated or otherwise formed to include a plurality of panels that, when assembled, form display container 50. In all FIGURES, like numbers indicate like parts. In addition, cut lines are shown as solid lines, score lines as dashed lines, and lines of perforation as broken lines.

Figure 1:
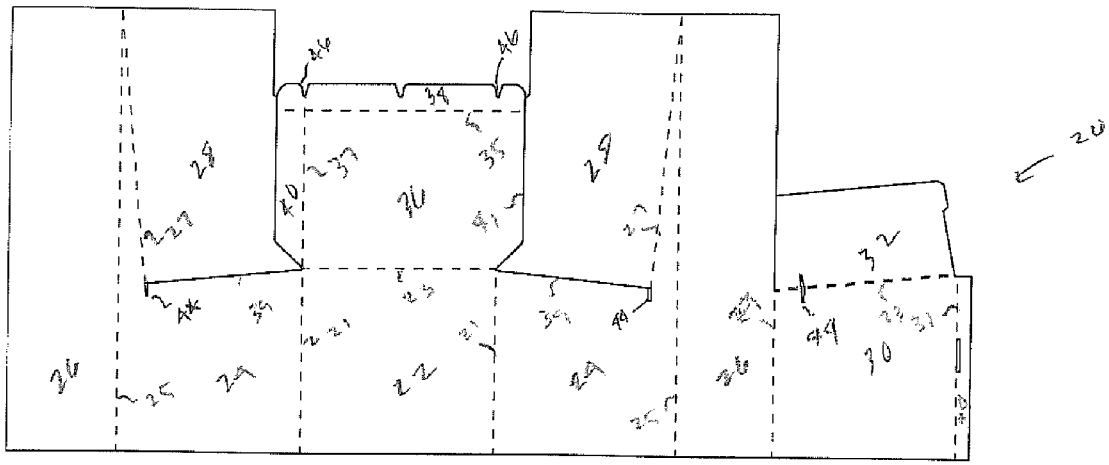
FIG. 1 is a plan view of a single piece of container blank formed in accordance with an aspect of the present invention.

With respect to FIG. 1, the blank includes a first side panel 22 that is defined by opposed fold lines 21 and fold line 23. Connected with the first side panel 22 along the fold line 23 is a cover 36. Cover 36 is bounded by opposed fold lines 23 and 35, cut line 41 and fold line 37. Additionally attached to the cover 36 along a fold line 37 is a cover side flap 40. Attached with the cover 36 is a cover end flap 38 connected with the cover 36 along a fold line 35. A cover end flap 38 includes a plurality of slots 46 formed on an edge opposite fold line 35.

Second side panel 24 is attached to the first side panel 22 along fold line 21. The second side panel 24 is bounded by opposed fold lines 21 and 25, as well as a cut line 39 that is interposed between, but not does not extend completely from, fold lines 21 to 25. Second side panel 24 also includes an extension on its upper end that is defined by the intersecting fold lines 25 and 27, as best seen in FIG. 1.

Additionally coupled with the second side panel 24 is a third side panel 26, which is connected with the second side panel along a fold line 25. One of the third side panels 26 includes a first divider panel 30 that is connected to the third side panel along a fold line 29. The first divider panel 30 is defined by opposed fold lines 29 and 31 that are essentially parallel to one another and fold line 33 that extends between fold lines 29 and 31. Fold line 31 may be slightly inclined with respect to fold line 29 and 31 as shown in the FIGURES. Conversely, fold line 31 may be substantially perpendicular the fold lines 29 and 31 (not shown). Connected with the first divider panel 30 along fold line 31 is a divider panel flap 34. Further a second divider panel 32 is connected to the first divider panel 30 along fold line 33.

A fourth side panel 28 is connected with the second side panel along a fold line 27. The remaining edges of the fourth side panel 28 remain free.

In order to further illustrate the various aspects of the embodiments, FIGS. 2 through 6 depict the blank 20 being erected into display container 50. It will be understood that mechanical box erecting equipment may be used in the erection of display container 50, either wholly or partially. However, it will also be appreciated that this display container 50 may also be hand erected or erected in another fashion that is commonly known in the art, such as combinations of hand-set and mechanical erecting process.

Figure 2:
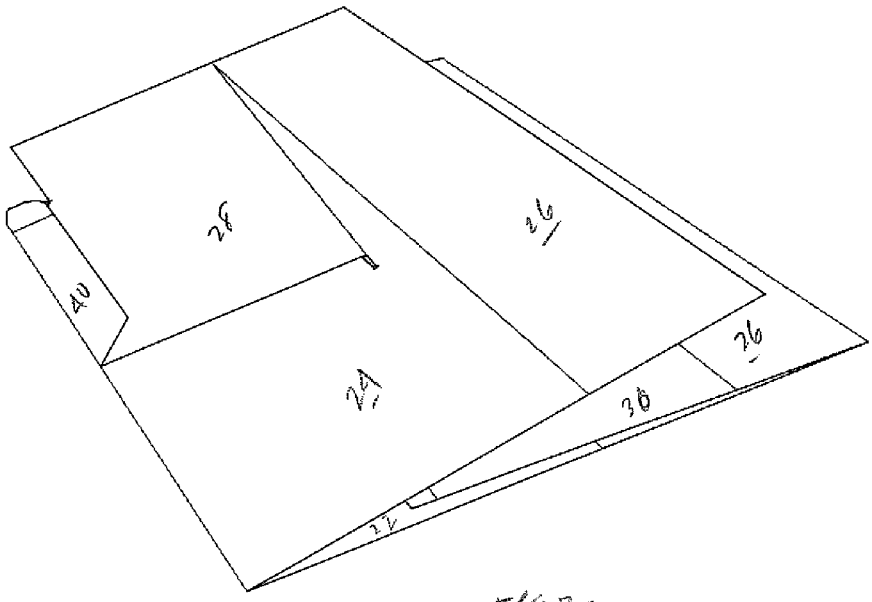
FIG. 2 is a perspective view of a partially assembled container, assembled according to an aspect of the present invention.
Figure 3:
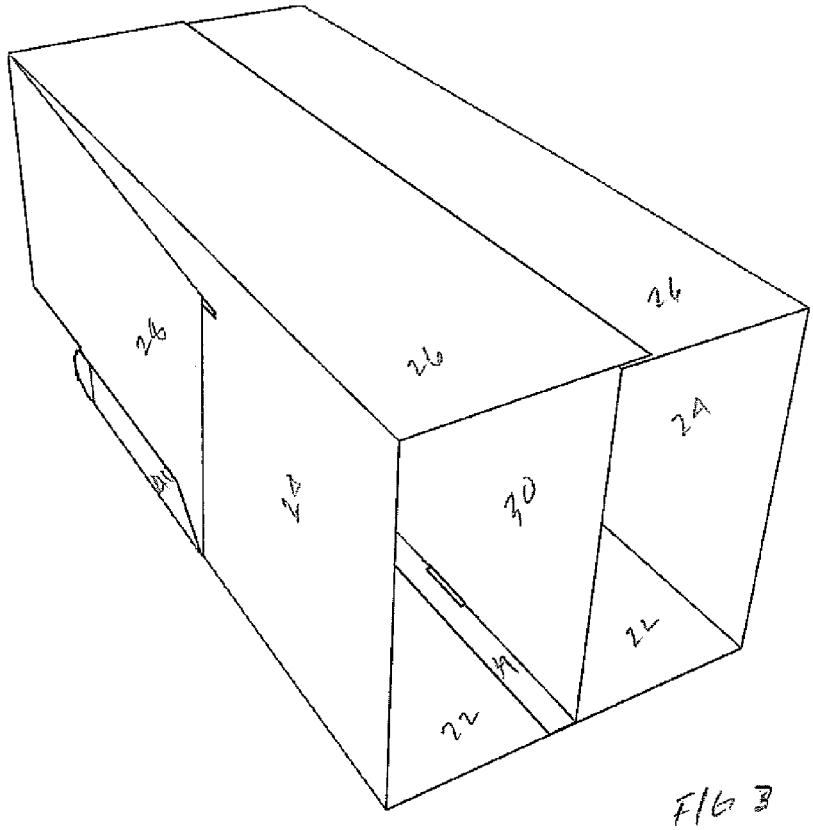
FIG. 3 is yet another perspective view of a partially assembled container assembly made in accordance with yet a further aspect of the present invention.

With specific reference to FIGS. 2 and 3, initial container assembly is created by folding one side of the blank 20 along a fold line 25 such that the third side panel 26 lies adjacent to the second side panel 24 and fourth side panel 28. At a time just subsequent to that, the other second side panel 24 may be folded inwardly along fold lines 21 and 37 such that the second side panel 24 lies adjacent to the first side panel 22 and a portion of the first divider panel 30, as best seen in FIG. 2. At this time some fastening mechanism such as, without limitation, adhesive or mechanical fasteners such as staples, brads or tacks may be used to connect the respective third side panels in an overlapping relationship, as best depicted in FIG. 3.

Also, the first divider panel 30 may be extended across an opening in the container bottom in a direction substantially perpendicular to the third side panel 26 such that the first divider panel extends from one of the third side panels 26 to the first side panel 22. At this point, the divider panel flap 34 may be laid adjacent to the first side panel 22 and may thereby be attached by any suitable means known in the art, such as an adhesive.

With the respective third side panels 26 joined together and the divider panel flap 34 joined to the first side panel 22, in an embodiment, this is considered the "pre-glued configuration." The container arrangement may be stored or shipped in this configuration to save space. From this knock-down configuration the container may be easily fully erected.

Figure 4:
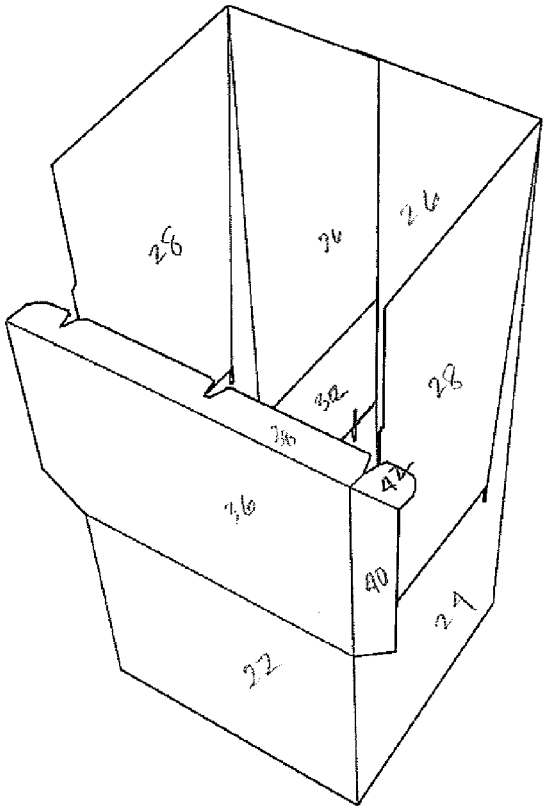
FIG. 4 is another perspective view of a partially assembled container constructed in accordance with the present invention.
Figure 5:
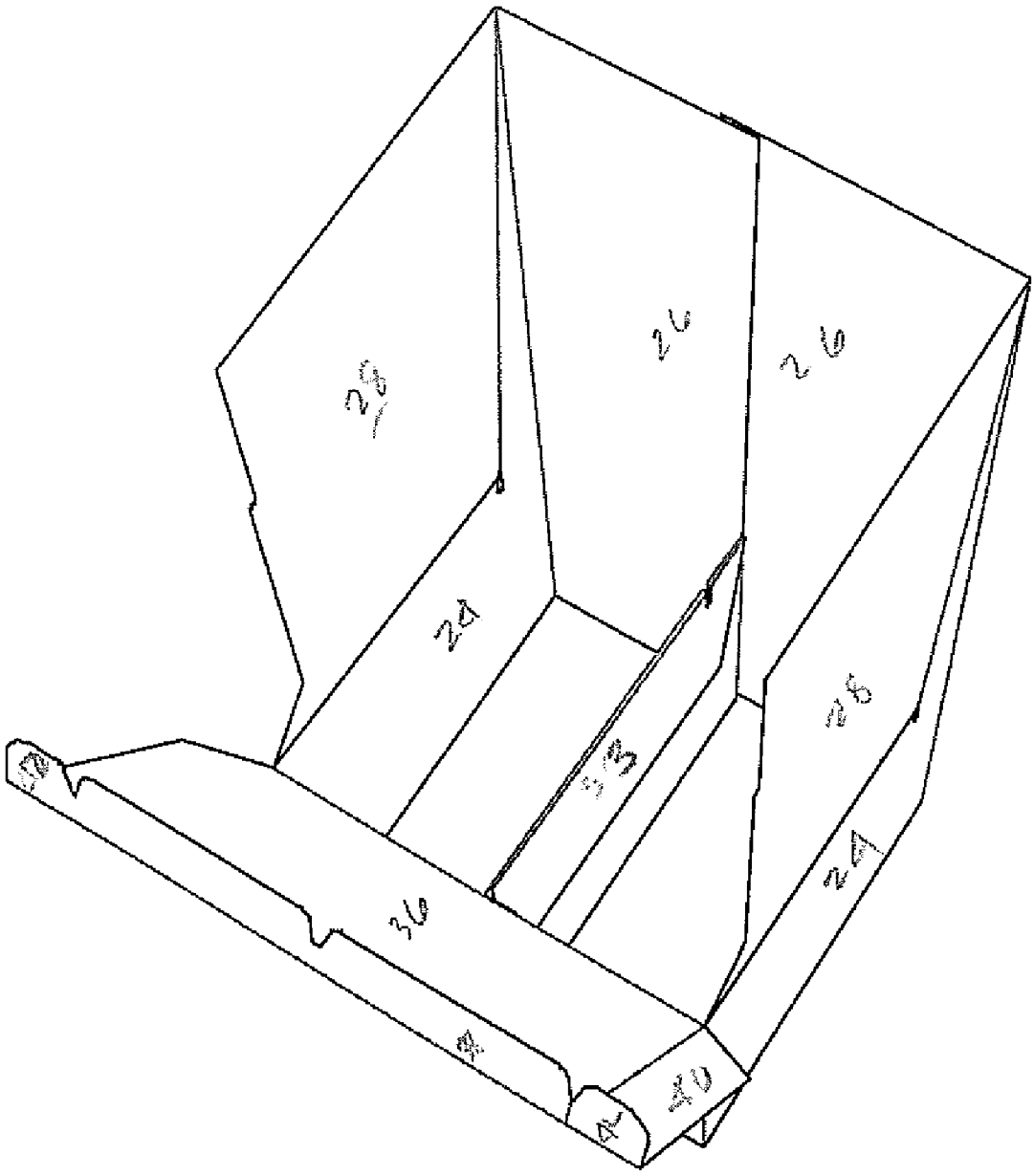
FIG. 5 is another perspective view of a partially assembled container constructed in accordance with the present invention; and, FIG. 6 is a perspective view of an assembled container according to certain aspects of the present invention.
Figure 6:
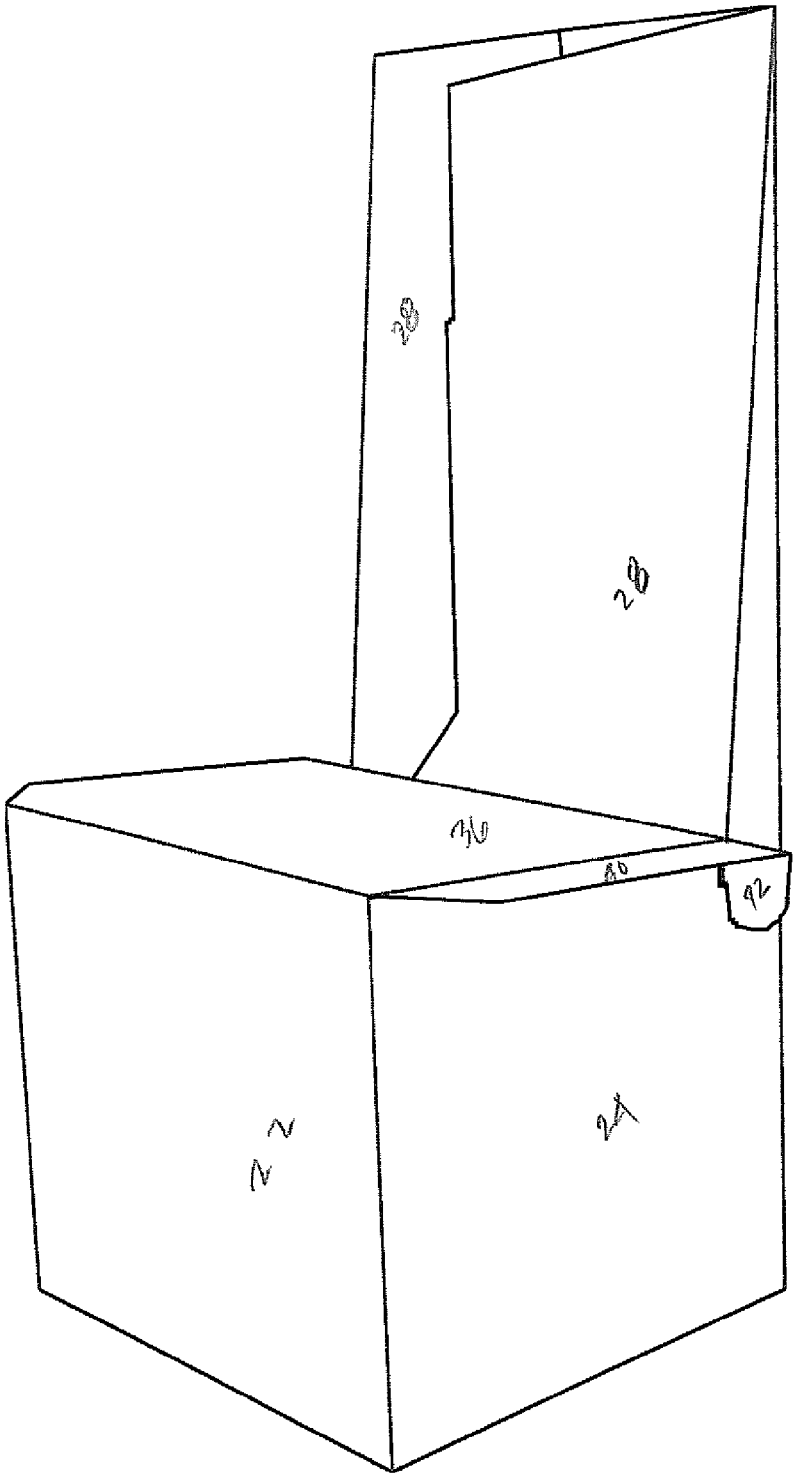

With respect to FIGS. 4-6, the remaining aspects of the container assembly are depicted. Specifically a view of the first divider panel 30 may be easily seen. In this embodiment the second divider panel 32 is folded such that the second divider panel 32 is adjacent to the first divider panel 30 to create a double thickness center support panel.

As can be seen best in FIG. 5, the folding over of the second divider panel 32 relative to the first divider panel 30 aligns the variety of slots 44 that are formed in conjunction with fold lines 33 and cut lines 39 as best seen in FIG. 1. The cover may then be folded downwardly approximately 90 degrees along fold line 23 such that the cover end flap 38 and its respective notches 46 align with and engage notches 44. The fourth side panels may then be rotated inwardly around fold lines 27.

After the cover 36 is folded downward such that the notches 44 and slots 46 are engaged, the cover side flap 40 may be folded approximately 90 degrees around fold line 37 to bring the cover side flap juxtaposed one of the second side panels 24. Also, the cover side flap tab 42 may then be folded and attached to the second side panel 24.

The display container 50 as shown is simple to manufacture, easy to assemble and may be a design of considerable usage in any variety of retail or wholesale commercial environments, such as club stores or bulk stores where products are displayed in large quantities on the open floor. However, this design is also useful in any variety of retail or wholesale environments.

While various embodiments of this invention have been illustrated and described, as noted above, many changes can be made without departing from the spirit and scope of this invention. Accordingly, the scope of the invention is not limited by the disclosure of the various embodiments. Instead, the invention should be determined entirely by references to the claims that follow.

What is claimed is:

1. A display container formed from a single sheet of foldable material, comprising:

a first side panel having a first edge, second edge, and third upper edge;

a pair of second side panels, one of the pair of second side panels connected with the first side panel along the first edge and the other of the pair of second side panels connected to the first side panel along the second edge;

a third side panel opposite the first side panel, the third side panel formed by a pair of third side panel members, the third side panel being taller than the first side panel;

the pair of second side panels extending between the first side panel and the third side panel;

a cover panel attached to the first side panel by a fold line, the cover panel extending between the pair of second side panels; and from the first side panel toward the third side panel;

a first divider panel connected with the first side panel and attached to one of the third side panel members by a fold line, said first divider panel being substantially parallel with the pair of second side panels, the first divider panel having an upper edge; and a second divider panel attached to the first divider panel by a fold line along the upper edge of the first divider panel, the latter fold line being the upper edge of the second divider panel.

2. The display container of claim 1, wherein the single sheet of foldable material is formed from a cellulose-based material.

3. The display container of claim 2, wherein the cellulose based material is formed from at least one of a wood pulp, straw, cotton, and bagasse.

4. The display container of claim 2, wherein the cellulose based material is in the form of at least one of a fiberboard, containerboard, corrugated containerboard and paperboard.

5. The display container of claim 1 wherein each of the second side panels has an upper edge which is aligned with the third upper edge of the first side panel at the juncture of each of the second side panels with the first side panel.

6. The display container of claim 5 wherein the upper edge of each of the second side panels extends downwardly from the first side panel toward the third side panel.

7. The display container of claim 5 wherein the upper edges of the first and second divider panels are aligned with the upper edges of each of the second side panels.

8. The display container of claim 7 further comprising downwardly extending slots in the upper edges the divider panels, the slots being aligned, and a cover end flap attached by a fold line to the end of the cover opposite the first side panel, the cover end flap having a slot on its outer edge aligned with the slots in the upper edges of the divider panels.

9. The display container of claim 7 further comprising downwardly extending slots in the upper edges of the pair of second side panels and the divider panels, the slots being aligned, the cover panel having a pair of side edges a pair of cover side flaps, one of the pair of cover side flaps attached by a fold line to one of the cover panel side edges, the other of the pair of cover side flaps attached by a fold line to the other of the cover panel side edges.

a cover end flap attached by a fold line to the end of the cover opposite the first side panel and to the cover side flaps, the cover end flap having slots on its outer edge aligned with the slots in the upper edges of the second side panels and the divider panels.

10. A blank for a display container comprising a sheet divided by first, second, third, fourth, fifth and sixth transverse fold lines to define a first third side panel member, a first second side panel, a first side panel, a second second side panel, a second third side panel member, a first divider panel, and a divider panel flap each of the first third side panel member, first second side panel, first side panel, second second side panel, second third side panel member, first divider panel and divider panel flap having lower and upper longitudinal edges, the lower longitudinal edges of the panels and members being aligned, the distance between the lower and upper longitudinal edges of the first side panel being less than the distance between the lower and upper longitudinal edges of the first and second third side panel members, a cover panel attached to the tipper longitudinal edge of the first side panel by a fold line;

a second divider panel attached to the upper edge of the first divider panel by a fold line.

* * * * *